US007828930B2

(12) United States Patent
Jiang

(10) Patent No.: US 7,828,930 B2
(45) Date of Patent: Nov. 9, 2010

(54) USE OF POLYSULFIDE IN MODIFIED COOKING

(75) Inventor: Jianer Jiang, Mason, OH (US)

(73) Assignee: International Paper Company, Memphis, TN (US)

( * ) Notice: Subject to any disclaimer, the term of this patent is extended or adjusted under 35 U.S.C. 154(b) by 414 days.

(21) Appl. No.: 11/986,304

(22) Filed: Nov. 20, 2007

(65) Prior Publication Data

US 2009/0126883 A1 May 21, 2009

(51) Int. Cl.
*D21C 3/00* (2006.01)

(52) U.S. Cl. ..... 162/82; 162/36

(58) Field of Classification Search ..... 162/19, 162/7, 17, 36, 82
See application file for complete search history.

(56) References Cited

U.S. PATENT DOCUMENTS

| | | | | |
|---|---|---|---|---|
| 3,661,698 | A | 5/1972 | Clayton et al. | |
| 3,664,919 | A | 5/1972 | Clayton et al. | |
| 5,023,103 | A | 6/1991 | Ramaswamy | |
| 5,522,958 | A | 6/1996 | Li | |
| 6,143,130 | A | 11/2000 | Stigsson et al. | |
| 6,153,052 | A | 11/2000 | Luthe et al. | |
| 6,241,851 | B1 | 6/2001 | Marcoccia et al. | |
| 6,468,390 | B1 | 10/2002 | Snekkenes et al. | |
| 6,576,084 | B1 | 6/2003 | Stromberg et al. | |
| 7,285,179 | B2 * | 10/2007 | Snekkenes et al. | 162/19 |
| 2002/0129911 | A1 * | 9/2002 | Marcoccia et al. | 162/41 |
| 2003/0131956 | A1 * | 7/2003 | Stromberg | 162/19 |
| 2004/0050196 | A1 | 3/2004 | Ma et al. | |
| 2004/0200589 | A1 | 10/2004 | Herring et al. | |
| 2005/0072539 | A1 | 4/2005 | van Heek et al. | |

(Continued)

FOREIGN PATENT DOCUMENTS

JP 2000-136491 5/2000

(Continued)

OTHER PUBLICATIONS

Wizani et al., Effect of Pretreatment with Green Liquor, AQ and Polysulfide on the Performance of an Extended batch system, 1998, TAPPI Pulping conference, whole document.*

(Continued)

*Primary Examiner*—Eric Hug
*Assistant Examiner*—Anthony J Calandra
(74) *Attorney, Agent, or Firm*—Richard C. Stewart, II; Matthew M. Eslami; Thomas W. Barnes, III

(57) ABSTRACT

A method for Kraft pulping employing a modified cooking process in conjunction with polysulfide pulping technologies to obtain higher pulping yields than obtained in the prior art. The total required alkali charge (polysulfide liquor) is added to the beginning of a cook, and after all polysulfide has essentially reacted with lignocellulosic material at temperature below that at which no significant carbohydrate degradation occurs, a first quantity of the cooking liquor high in effective alkali (EA) concentration is removed from a first point in the pulping process and replaced with a cooking liquor low in EA concentration removed from another process point. The first quantity is then added elsewhere in the pulping process, where the EA concentration is low. This cooking liquor "exchange" obtains the full yield benefit from polysulfide pulping and a more uniform EA concentration profile to retain the major benefits of modified cooking.

11 Claims, 5 Drawing Sheets

U.S. PATENT DOCUMENTS

2006/0175029 A1 * 8/2006 Martikainen et al. ..... 162/37

FOREIGN PATENT DOCUMENTS

| | | |
|---|---|---|
| WO | WO 99/14423 A1 * | 3/1999 |
| WO | WO9914423 | 3/1999 |
| WO | WO9945191 | 9/1999 |
| WO | WO 2005/064075 | 7/2005 |

OTHER PUBLICATIONS

Olsson, J.-E and Samuelsson, O., "Inorganic reactions during polysuldie cooking," Svensk Paperstid. 69(20): 703 (1966).
Harlter, N., "Recent experiences in polysulfide cooking," Tappi 50(3): 156 (1967).
Sanyer, N., "Progress and prospects of polysulfide pulping," Tappi 51(8): 172 (1975).
Teder, A., "Some aspects of the chemistry of polysulfide pulping," Svensk Paperstid. 72(9): 294 (1969).
Smith, G. C., Knowles, S.E., and Green, R.P., "All it takes is Moxy: Mead oxidation system generates polysulfide liquor," Paper Trade J. 159 (13): 38 (1975).
Kleppe, P.J., "Polysulfide pulping in a dual-vessel Kamyr digester," Tappi 58 (8): 172 (1975).
Green, R.P. and Prusas, 2.C., "Polysulphide puling of two Canadian softwood blends," Pulp Paper Can. 76(9): 69 (1975).
Ringley, M.B., "Laboratory polysulfide cooking of loblolly pine," Southern Pulp Paper Mf. 39(1): 24 (1976).
Teder, A. and Tormund, D., "Low-kappa-number polysulfide pulps are easy to bleach," Tappi 64(4): 138 (1981).
Pekkala, O., "On Extended delignification using polysulfide or anthraquinone in kraft pulping." Puperi Puu 64(11): 735 (1982).
Johansson, B., et al., "Modified continuous kraft pulping—now a reality," Svensk Paperstid. 87(10): 30 (1984).
Jiang, J., "Extended modified cooking with polysulfide for simultaneous pulp yield and strength improvement," Tappi Pulping Conf. Proc., vol. 2, p. 683, Tappi Press, Atlanta.
Jiang, J., "Extended modified cooking of southern pine with polysulfide: effects on pulp yield and physical properties," Tappi J. 77(2): 120 (1994).
Mao, B. and Hartler, N., "Improved modified kraft pulping, Part 3: Modified vapor-phase polysulfide cooking," Tappi J. 77(11): 149 (1994).
Jiang, J., "Extended delignification of souther pine with anthraquinone and polysulfide," Tappi J. 78(2): 126 (1995).
Jiang, J. and Lowe, R.W., "Extended modified cooking of southern pine with polysulfide-Effect on elemental-chlorine-free bleaching," JPPS 21(3): J76-J80 (1995).
Griffin, C., et al., "Effect of adding anthraquinone and polysulfide to the modified continuous cooking (MCC) process," Tappi Pulping Conference Proceedings, p. 19, Tappi Press.
Hakanen, A and Teder, A., "Modified kraft pulping with polysulfide: yield, viscosity, and physical properties," Tappi J. 80(7): 189 (1997).
Gustafsson, et al., "Polysulfide pretreatment of softwood for increased delignification and higher pulp viscosity," JPPS 30(5): 129 (2004).

* cited by examiner

USE OF POLYSULFIDE IN MODIFIED COOKING

FIELD OF THE INVENTION

The present invention relates to a Kraft pulping process employing modified cooking technology in conjunction with polysulfide pulping technology in a cooking vessel to obtain higher pulping yields than previously obtained with either modified cooking or polysulfide pulping.

BACKGROUND OF THE INVENTION

Polysulfide (PS) is a pulping additive which has been used commercially to increase pulping yield. A higher pulping yield improves process economics by decreasing wood consumption and/or increasing pulp throughput. Polysulfide is commercially produced by catalytic oxidation of part of the sulfide ions contained in Kraft pulping alkali solution, often called "white liquor" in the art of Kraft pulping. This oxidation process is currently the most commercially viable technology that converts sulfide in white liquor to polysulfide, giving the resultant liquor an orange color. Polysulfide alkali liquor thus is also called "orange liquor" in the art.

Polysulfide is found to be effective in increasing pulping yield only when it is applied to the beginning of a cook, e.g., to an impregnation stage where the temperature is typically below ~140° C. (~284° F.) and a retention time of typically 15-45 minutes. At or above ~140° C. (~284° F.), polysulfide starts to decompose rapidly and loses its effectiveness as a pulping yield enhancer. Pulping yield increase from polysulfide pulping is found to increase proportionately with amounts of polysulfide added to the beginning of a cook (up to about 7% polysulfide charged on wood). Thus in polysulfide pulping, all polysulfide liquor (orange liquor) is most preferably added to the beginning of a cook so as to maximize pulping yield increase. This feature works well with conventional Kraft pulping. In conventional Kraft pulping, which had been the only commercial practice until the late 1970s, the total alkali charge required for a cook is added to the beginning of the cook.

In modified Kraft pulping (modified cooking) developed in the late 1970s, the total alkali charge is divided into at least two and often more than two additions. Typically, only about 45-75% of the total alkali is added to the beginning of a modified cook. By splitting the total alkali charge into several additions to different cooking stages, alkali concentration profile in modified cooking is more even throughout the cook than in conventional Kraft cooking. Of particular importance is the concentration of effective alkali (EA) in the early cooking stage, where the cooking temperature goes from an impregnation temperature of typically ≦135° C. (≦275° F.) to full cooking temperature, typically between 150 to 175° C. (302 to 347° F.). When the EA concentration is too high in this early cooking stage, excessive losses occur in pulping yield and pulp strength. Therefore, modified cooking with a more even alkali profile, particularly a lower EA concentration in the early cooking stage, results in significantly higher pulping yield and pulp strength than conventional Kraft pulping, where the total alkali charge is all added to the beginning of a cook and the EA concentration is high at the early stage.

However, when current commercial polysulfide pulping technology is applied to modified cooking, only 45-75% of the total available polysulfide is added to the beginning of a cook, since only 45-75% of the polysulfide-containing alkali liquor is added to the beginning of the cook. As a result, compared to conventional cooking with polysulfide, only a fraction of the total pulping yield increase is realized because the yield increases are proportional to the amount s of polysulfide added to the beginning of a cook as discussed before. This means that in the prior art, current modified cooking cannot take full advantage of polysulfide pulping for maximum yield increases. In other words, the current modified cooking technology is not completely compatible with the current commercial polysulfide pulping technology.

The present invention overcomes the aforementioned incompatibility of modified Kraft pulping with current commercial polysulfide pulping technology. It obtains all benefits of modified cooking as compared to conventional cooking, and the full yield improvement of polysulfide pulping.

SUMMARY OF THE INVENTION

The invention comprises a method directed to Kraft pulping employing a modified cooking process in conjunction with polysulfide pulping technology in a cooking vessel to obtain higher pulping yields than is obtained with modified cooking without polysulfide, conventional cooking with polysulfide or polysulfide pulping applied to modified cooking as taught in the prior art. In the present invention, the entire cooking alkali dosage required in the form of polysulfide liquor is added to the beginning of a cook, usually an impregnation stage, as in the case of conventional cooking. At the end of the impregnation stage, when all polysulfide has essentially reacted with lignocellulosic material to increase pulping yield at temperature below ~135° C. (~275° F.), at or below which no significant carbohydrate degradation occurs, e.g., near the end of the impregnation stage, part of the cooking liquor (first quantity) high in effective alkali (EA) concentration is removed from the cooking process and replaced with a cooking liquor (second quantity) low in EA concentration and that is removed from another process point, and which may be equal to, greater than, or smaller than the first quantity. The removed first quantity of cooking liquor is then added elsewhere in the pulping process, where the EA concentration is low, for instance near where the second quantity of cooking liquor is removed. By performing this cooking liquor "exchange," the full yield benefit from polysulfide pulping is realized while at the same time a more uniform EA concentration profile is achieved to obtain the benefits of higher pulp yield and strength from modified cooking.

More specifically, the invention comprises, in an embodiment, the steps of: (a) adding the total alkali charge in the form of polysulfide liquor to the first stage of a cook operated at between 100-140° C. within about 15-45 minutes; (b) at the end of the first stage, removing from the vessel a first quantity of cooking liquor relatively high in effective alkali (EA) concentration, which is to be added back to the vessel in a later stage; (c) adding to the end of the first stage a second quantity of cooking liquor, which was removed from a later stage of the cook and is relatively low in EA concentration; (d) heating the cook to full cooking temperature; (e) wherein the second quantity cooking liquor is removed about 0-200 minutes after the full cooking temperature is reached; (f) adding the first quantity of cooking liquor to the vessel to a later stage in the cooking process than its point of removal, or to another cooking process; and (g) continuing cooking to completion. The quantities, as well as the removal and addition points or times, of the first and second cooking liquors are controlled to obtain an EA concentration profile that is similar to that of current modified cooking and more uniform than that of conventional Kraft cooking.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE INVENTION

Figure 1A:
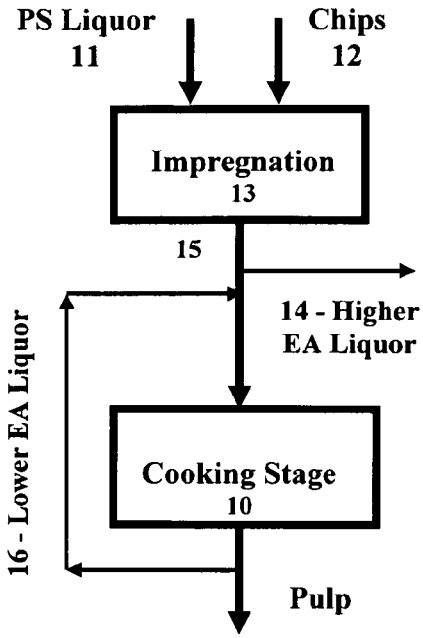
FIGS. 1*a* & 1*b* are schematic flow diagrams of a cooking process according to a preferred embodiment of the present invention.

The cooking process of the present invention is indicated generally for a pulping process with one impregnation stage and one concurrent cooking stage at 10 in FIG. 1*a*. According to the present invention, 100% of the required alkali dosage, in the form of polysulfide (PS) liquor stream 11, is added with wood chips stream 12 to the impregnation stage 13 of a reaction vessel (digester), e.g., at the top of a continuous digester. After reaction at up to ~135° C. (~275° F.) for about 15-60 minutes, when essentially all polysulfide has reacted with lignocellulosic material to stabilize carbohydrates for pulping yield increase, a first quantity 14 of the post-impregnation liquor is removed from the total post-impregnation liquor 15, which is relatively high in EA concentration. A second quantity 16 of liquor relatively low in EA concentration is removed from another process point, which is at least 30 minutes after the target full cooking temperature has been reached in the cooking stage or at the end of the cooking stage, and added back to the reaction vessel at or immediately downstream of the process point where the first quantity of the higher EA liquor was removed. The second quantity may be equal to, greater than or smaller than the first quantity of the cooking liquor removed. The removed first quantity of cooking liquor high in EA concentration is sent to another process, e.g., another pulping process with or without the use of polysulfide.

Figure 1B:
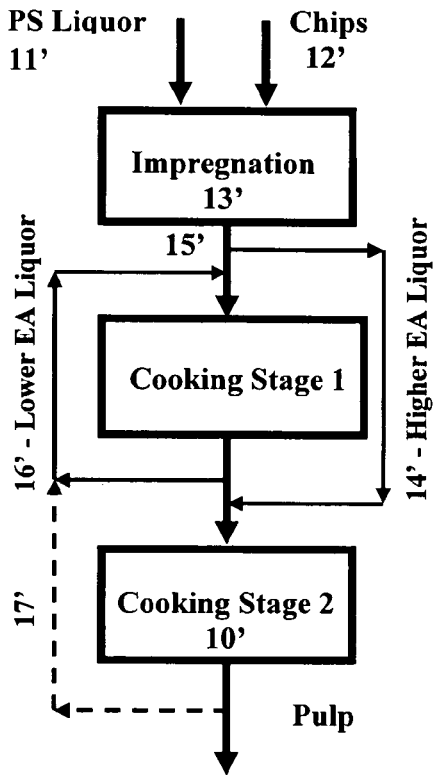

Another embodiment of the present invention is depicted in FIG. 1*b*. The pulping process 10' consists of one impregnation stage 13' and two concurrent cooking stages. According to the present invention, 100% of the required alkali dosage, in the form of polysulfide (PS) liquor stream 11', is added with wood chips stream 12' to the impregnation stage 13' of a reaction vessel (digester), e.g., at the top of a continuous digester. After reaction at up to ~135° C. (~275° F.) for about 15-60 minutes, when essentially all polysulfide has reacted with lignocellulosic material to stabilize carbohydrates for pulping yield increase, a first quantity 14' of the post-impregnation liquor is removed from the total post-impregnation liquor 15', which is relatively high in EA concentration. A second quantity 16' or 17' of liquor relatively low in EA concentration is removed from another process point, which is at least 30 minutes after the target full cooking temperature has been reached in the first cooking stage, or at the end of the first cooking stage or alternatively at the end of the second cooking stage, and added back to the reaction vessel at or immediately downstream of the process point where the first quantity of the higher EA liquor was removed. The second quantity may be equal to, greater than or smaller than the first quantity of the cooking liquor removed. The removed first quantity of cooking liquor high in EA concentration is added back to the reaction vessel downstream of its removal point, at or immediately downstream of the removal point for the second quantity of cooking liquor.

The terms of downstream and upstream are referenced to the free liquor flow direction inside the cooking vessel in a continuous digester, or to the process time of a batch cooking system with multiple batch digester vessels. By adjusting the quantities of the first and the second of cooking liquor and the process points for their removal and addition, one skilled in the art of Kraft pulping is able to achieve a relatively even EA concentration profile in the subsequent cooking stages (Cook Stages 1 and 2), comparable to that obtained from current modified cooking. Thus, the present invention enables one to achieve the full potential benefits of pulp yield increases from PS pulping, as well as the higher pulp yield and strength from a more even EA concentration profile as obtained in modified cooking, thereby overcoming the incompatibility of prior art modified cooking when using commercially available polysulfide pulping technologies.

Yet another embodiment of the present invention is to (a) add the total required alkali charge in the form of polysulfide cooking liquor (orange liquor) to the very first stage of a cook, usually an impregnation stage, and control the stage conditions, typically around or below 135° C. (275° F.) for 15-45 minutes, such that essentially all polysulfide has reacted with lignocellulosic material and no substantial carbohydrates degradation and polysulfide thermal decomposition occur; and (b) adjust the amounts of the first quantity and the second quantity of liquors to be removed from certain process points and to be added back to the cook at other process points, as well as their relative removal and addition process points, so as to keep the maximal concentration of effective alkali at or below 18 g/L as NaOH (0.45M NaOH or 14 g/L as $Na_2O$) throughout all cooking stages that follow the impregnation stage.

Alternatively, the present invention can be practiced where the maximal effective alkali concentration in all cooking stages that follow the impregnation stage is controlled to be at or below 24 g/L as NaOH (0.6M NaOH or 18.6 g/L as $Na_2O$).

Another way to practice the present invention is to control the maximal alkali concentration at or below 12 g/L as NaOH (0.3M NaOH, or 9.3 g/L as $Na_2O$) in all cooking stages that follow the impregnation stage.

EXAMPLES

Example 1

Figure 2:
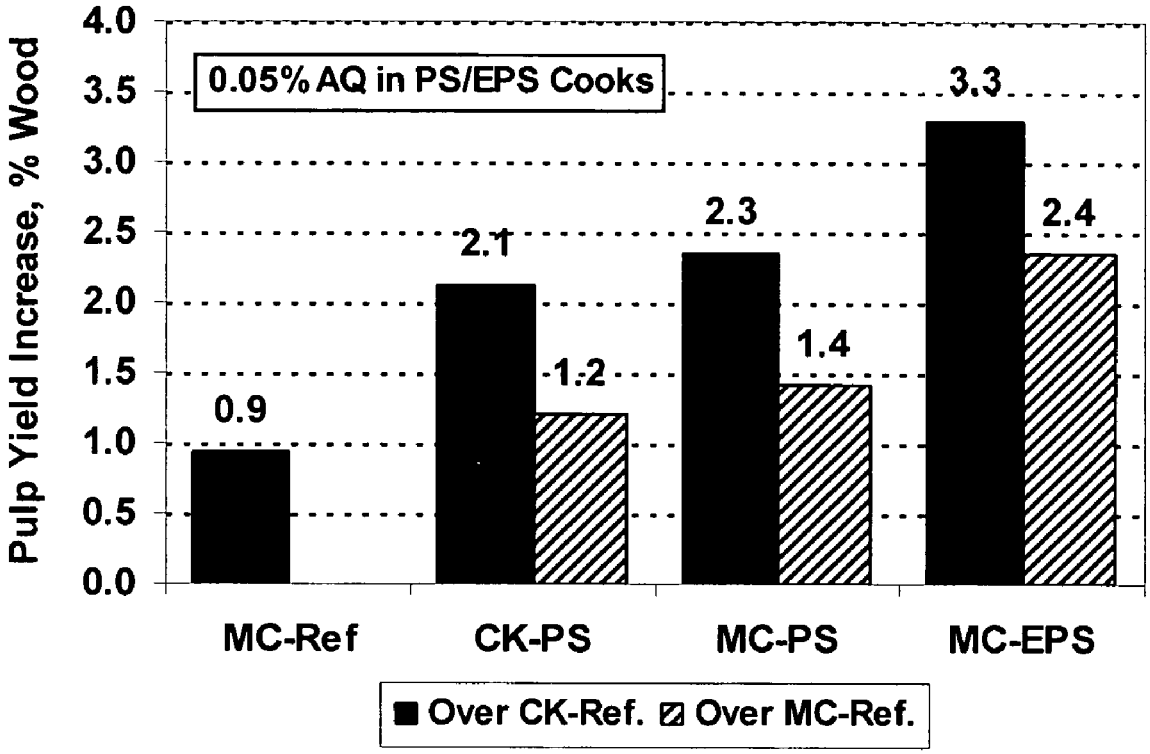
FIG. 2 is a chart comparing the screened pulp yield increases of modified cooking (MC-Ref), conventional Kraft with polysulfide (CK-PS), modified cooking with polysulfide (MC-PS), and modified cooking with the enhanced polysulfide process of the invention (MC-EPS), relative to conventional Kraft (CK), at 15 Kappa number from laboratory cooking of mixed southern US hardwoods with 0.05% (on OD wood) anthraquinone added.

Table 1 summarizes the pulping yields from cooking mixed southern US hardwood furnish to 15 Kappa number at the laboratory. These results are also depicted in FIG. 2.

CK-Ref denotes reference cooks of conventional Kraft cooking, which is comprised of: (a) heating up the chips with low-pressure steam at ~100° C. (~212° F.) for 10 minutes in a laboratory digester vessel equipped with external circulation and an electric heater; (b) draining off all free steam condensate; (c) adding all cooking alkali liquor (in form of white liquor with a sulfidity of ~30% on active alkali (AA) basis), corresponding to EA/wood charge of 20.0% as NaOH (15.5% as $Na_2O$) at the beginning of a cook, and bringing the cooking liquor/wood ratio to 3.5 by adding the proper amount of water to the cook; (d) heating up the cook from about 60° C. to 120° C. in 15 minutes; (e) maintaining the cook at 120° C. for 30 minutes to effect an impregnation stage; (f) heating up the cooking to full cooking temperature of about 160° C. (320° F.) in 30 minutes and maintaining the cook at this temperature for 100 minutes to reach a target Kappa number of ~15; (g) cooling the cook down to below 100° C.; (h) washing the cooked chips with tap water; (i) processing the washed cooked chips into fibers (pulp) by mechanical mixing in a dilute water suspension; and (j) screening the pulp using a laboratory flat screen with 0.25 mm (0.01") slots before determination of pulping yield, rejects, Kappa number and other pulp properties.

MC-Ref denotes reference cooks carried out with a modified cooking process, comprising essentially the same steps as outlined above for the CK-Ref cooks, expect for step (c), adding only 65% of the total alkali charge at the beginning of a cook, and step (f), adding the second EA addition equal to 20% of the total alkali charge to the cook by a metering device before heating up the cook to 157° C. (~315° F.) in 30 minutes, maintaining the temperature for 45 minutes before adding the third EA addition equal to 15% of the total alkali charge, and continuing the cook at this full cooking temperature for another 150 minutes to reach a target Kappa number of ~15.

CK-PS and MC-PS represent polysulfide (PS) cooks performed using the aforementioned CK-Ref and MC-Ref procedures, respectively, and instead of white liquor using PS liquor, produced by catalytic oxidation of white liquor, containing an amount of total polysulfide equivalent to 0.7% charge on wood and with a sulfidity of ~14% on AA. In addition, a charge of anthraquinone (AQ) equal to 0.05% on wood was added to these PS cooks with the first EA charge at the beginning of a cook.

The MC-EPS cooks were done using the present invention, and were performed in the following steps: (a) heating up the chips with low-pressure steam at ~100° C. (~212° F.) for 10 minutes in a laboratory digester vessel equipped with external circulation and an electric heater; (b) draining off all free steam condensate; (c) adding 0.05% AQ and the total required alkali charge in the form of PS liquor (containing an equivalent of 0.7% PS on wood with a sulfidity of 14% on AA basis), corresponding to EA/wood charge of 20.0% as NaOH (15.5% as $Na_2O$) at the beginning of a cook, and bringing the cooking liquor/wood ratio to 3.5 by adding proper amount of water to the cook; (d) heating up the cook from about 60° C. to 120° C. in 15 minutes; (e) maintaining the cook at 120° C. for 30 minutes to effect an impregnation stage; (f) collecting a first quantity of cooking liquor relatively high in EA concentration, in an amount equivalent to about 1.2 times the total wood charge by weight through a cooling device from the digester vessel for use in the next MC-EPS cook; (g) adding to the digester vessel via a metering device a second quantity of cooking liquor relatively low in EA concentration collected from a previous MC-EPS cook; (h) heating up the cook to full cooking temperature of about 157° C. (315° F.) in 30 minutes and maintaining the cook at this temperature for 45 minutes; (i) collecting a second quantity of cooking liquor in an amount equivalent to about 1.2 times the total wood charge by weight through a cooling device from the digester vessel and storing this second quantity of cooking liquor relatively low in EA concentration for use in the next MC-EPS cook; (j) adding to the digester vessel via a metering device the first quantity of cooking liquor collected from a previous MC-EPS cook, and maintaining the full cooking temperature during this liquor exchange; (k) continuing the cook at this full cooking temperature for another 150 minutes to reach a target Kappa number of ~15; (l) cooling the cook down to below 100° C.; (m) washing the cooked chips with tap water; (n) processing the washed cooked chips into fibers (pulp) by mechanical mixing in a dilute water suspension; and (o) screening the pulp using a laboratory flat screen with 0.25 mm (0.01") slots before determination of pulping yield, rejects, Kappa number and other tests.

TABLE 1

Pulp Yields at 15 Kappa Number for Southern US Mixed Hardwoods.

| | Cook Type | | | | |
|---|---|---|---|---|---|
| | CK-Ref | MC-Ref | CK-PS | MC-PS | MC-EPS |
| Screened Yield, % on Wood | 47.1 | 48.0 | 49.2 | 49.4 | 50.4 |
| Increase Over CK-Ref, % | — | 0.9 | 2.1 | 2.3 | 3.3 |
| Increase Over MC-Ref, % | | | 1.2 | 1.4 | 2.4 |

0.05% AQ (anthraquinone) added to all PS and EPS cooks

The results show that modified cooking of southern US mixed hardwood to 15 Kappa number (MC-Ref) resulted in a pulp yield increase of about 0.9% on wood over conventional reference cooks (CK-Ref). Charging the total required alkali charge in the form of PS liquor containing about 0.7% PS and 0.05% AQ, both on OD wood basis, to the beginning of a conventional Kraft cook (CK-PS) increased the pulp yield by about 2.1% over conventional reference cooks, and about 1.2% points over the MC-Ref cook. As expected based on teaching from the prior art, when 65% of the total PS liquor was added to the beginning and the balance of the PS liquor to the subsequent cooking stages of a modified cook (MC-PS), the total pulp yield increase was only 1.4% on wood over that of the MC-Ref (2.1% over CK-Ref), which is significantly lower than the expected sum of (0.9%+2.1%)=3.0% yield increases from both modified cooking and PS addition. When applying the present invention, i.e., the enhanced PS process with modified cooking (MC-EPS), the total pulp yield increase was found to be 3.3% on wood, which is approximately the sum of the 0.9% increase from modified cooking over conventional Kraft cooking and the 2.1% expected from PS pulping.

Example 2

Figure 3:
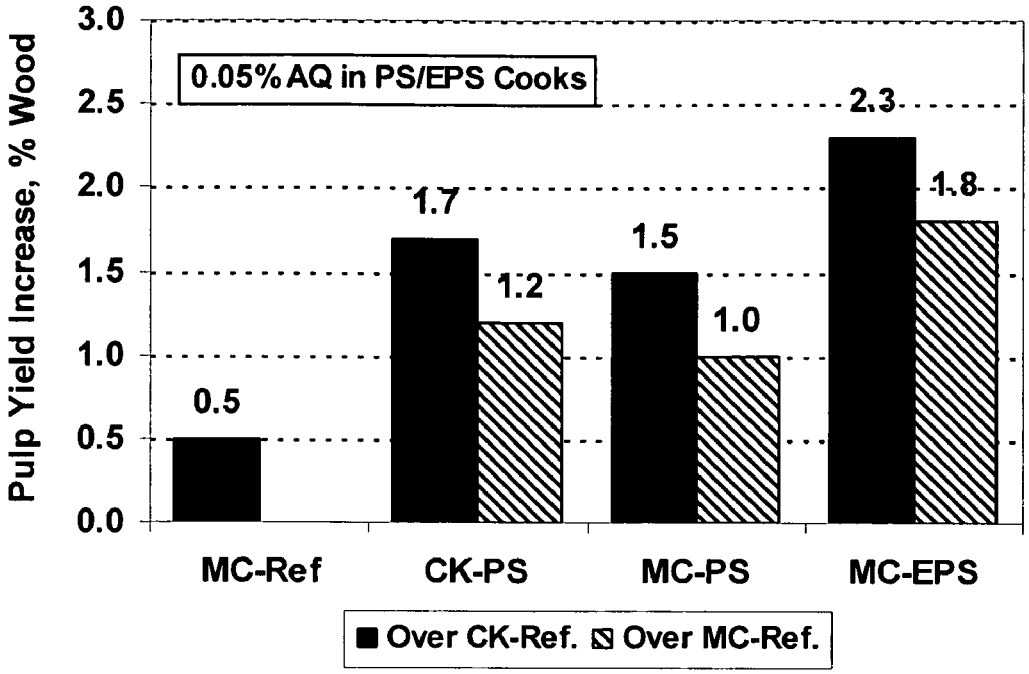
FIG. 3 is a chart comparing the screened pulp yield increases of modified cooking (MC-Ref), conventional Kraft with polysulfide (CK-PS), modified cooking with polysulfide (MC-PS), and modified cooking with the enhanced polysulfide process of the invention (MC-EPS), relative to conventional Kraft (CK), at 30 Kappa number from laboratory cooking of southern pine with 0.05% (on OD wood) anthraquinone added.

Similar results were found in laboratory pulping of southern pine, as summarized in Table 2 and depicted in FIG. 3. The cooking procedures were the same as those described in Example 1 for each type of cook.

Modified cooking (MC-Ref) to about 30 Kappa number was found to increase pulping yield by ~0.5% on wood over conventional Kraft reference (CK-Ref) cooks. Adding 0.05% AQ and 0.7% PS to CK cooks increased the pulp yield by about 1.7% on wood. As expected based on teaching from the prior art, performing PS pulping with MC cooking without the use of the present invention, i.e., splitting the total alkali charge into multiple additions and only adding about 65% of total alkali charge to the beginning of a cook, the total pulp yield increase was only ~1.5% over CK-Ref and 1.0% over MC-Ref, significantly lower than the expected sum of ~2.2% (~0.5% from modified cooking and 1.7% from PS addition). When applying the present invention using the enhanced PS process concept, the total pulp yield increase in the MC-EPS cooks was ~2.3% over that of CK-Ref and ~1.8% over that of MC-Ref cooks.

TABLE 2

Pulp Yields at 30 Kappa Number for Southern Pine Furnish 1.

| | Cook Type | | | | |
|---|---|---|---|---|---|
| | CK-Ref | MC-Ref | CK-PS | MC-PS | MC-EPS |
| Screened Yield, % on Wood | 44.6 | 45.1 | 46.3 | 46.1 | 46.9 |
| Increase Over CK-Ref, % | | 0.5 | 1.7 | 1.5 | 2.3 |
| Increase Over MC-Ref, % | | — | 1.2 | 1.0 | 1.8 |

0.05% AQ added to all PS and EPS cooks

Example 3

In another laboratory pulping study using a different southern pine furnish, but without adding AQ to any cooks, the results also clearly show the significant advantage of the present invention. The cooking procedures were the same as those described in Example 1 for each type of cook.

Figure 4:
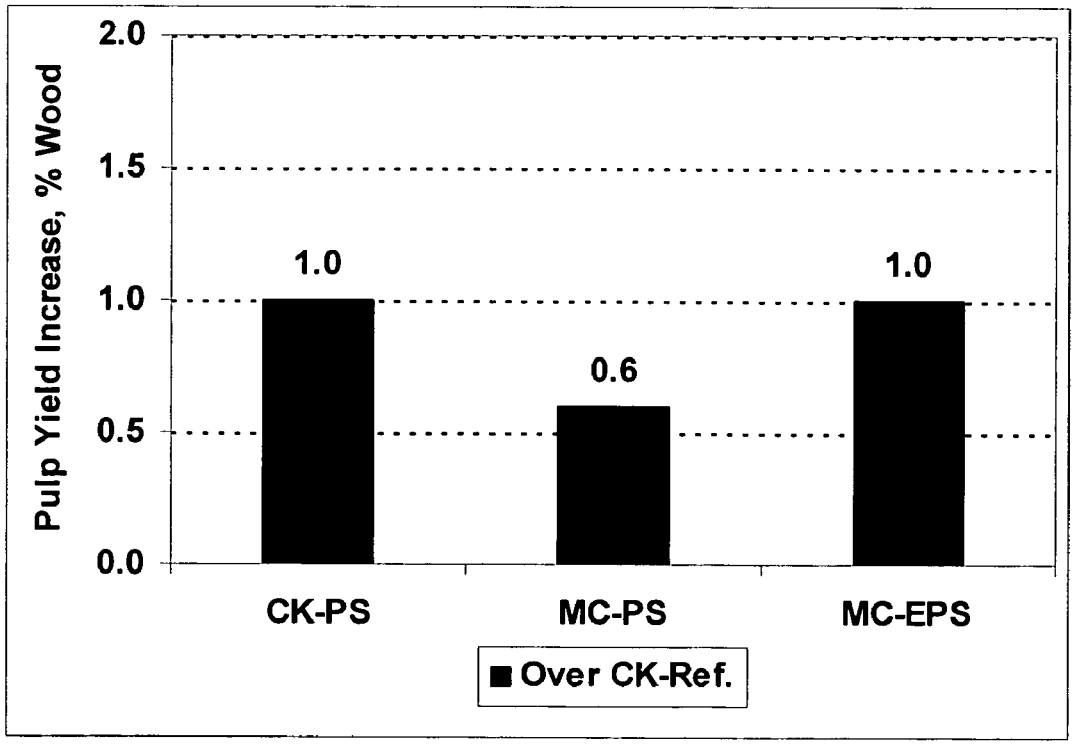
FIG. 4 is a chart comparing the screened pulp yield increases of conventional Kraft with polysulfide (CK-PS), modified cooking with polysulfide (MC-PS), and modified cooking with the enhanced polysulfide process of the invention (MC-EPS), relative to conventional Kraft (CK) at 30 Kappa number from laboratory cooking of another southern pine furnish with no anthraquinone added.

As can be seen in Table 3 and FIG. 4, adding the total required alkali charge in the form of PS liquor (containing 0.7% PS on wood) to the beginning of a cook (CK-PS) was found to increase the pulp yield by about 1.0% on wood. As expected based on teaching from the prior art, performing PS pulping with modified cooking without the use of the present invention, i.e., splitting the total PS liquor into multiple charges and only adding about 65% of total PS liquor to the beginning of a cook (MC-PS), the total pulp yield increase was only ~0.6% over CK-Ref. When applying the present invention using the enhanced PS pulping concept with modified cooking (MC-EPS), the total pulp yield increase in the MC-EPS cooks was ~1.0% over that of CK-Ref cooks.

TABLE 3

Pulp Yields at 30 Kappa Number for Southern Pine Furnish 2.

| Cook Type | CK-Ref | CK-PS | MC-PS | MC-EPS |
|---|---|---|---|---|
| Screened Yield, % on Wood | 45.4 | 46.4 | 46 | 46.4 |
| Increase Over CK-Ref, % | — | 1.0 | 0.6 | 1.0 |

No AQ added to any cooks

The above three examples clearly demonstrate the advantages of the present invention over the prior art in the use of polysulfide pulping with modified cooking processes.

Example 4

Figure 5:
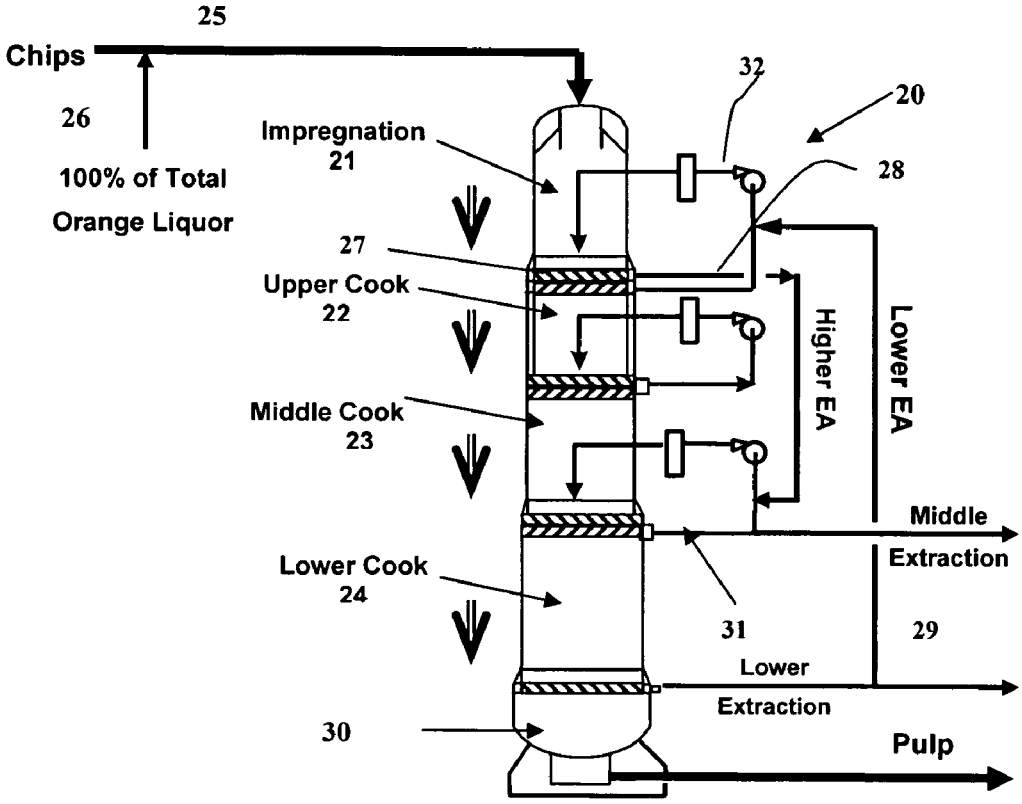
FIG. 5 shows an exemplary embodiment of the present invention in a vertical single-vessel continuous digester, wherein the cook zones are all co-current.

FIG. 5 illustrates an exemplary embodiment of the present invention in a vertical single-vessel continuous digester 20 comprising one impregnation stage 21 at the top, and three co-current cook stages 22, 23 and 24 below the impregnation stage. A first circulation loop 25 exits the digester at the end of the impregnation stage and re-enters the impregnation stage near the upper end of the digester. A second circulation loop 26 exits the digester at the end of the first cook stage 22 and re-enters the first cook stage near its upper end. A third circulation loop 27 exits the digester at the end of the second cook stage 23 and re-enters the second cook stage near its upper end. Wood chips 28, usually after steaming for preheating and air removal, and 100% of the total required alkali charge in the form of PS liquor 29 are fed to the top of the digester, i.e., the beginning of a cook. The chips and cooking liquor move downward from the top to the first set of screens 30, typically in 30-45 minutes within a temperature range of ~110° C. to ~135° C. in this so-called impregnation stage. At the end of this impregnation stage essentially all PS has reacted with woody components, rendering the carbohydrates in wood chips more stable against alkali-catalyzed degradation and a higher pulping yield. A first quantity 31 of cooking liquor, relatively high in EA concentration, is removed via the first set of screens 30 immediately after the impregnation stage near the top of the digester as shown in FIG. 5. A second quantity 32 of cooking liquor, relatively low in EA concentration, is removed from the last (lowest) set of screens 33 as shown in FIG. 5. Alternatively, but not shown, the second quantity of cooking liquor can be removed from the second last (middle) set of screens 34. The removed first quantity of cooking liquor 31 is added back to the digester at the third circulation loop 27 as shown in FIG. 5, or alternatively, but not shown, at the second circulation loop 26. The removed second quantity 32 of cooking liquor is added back to the digester at the first circulation loop 25 as shown in FIG. 5, or alternatively (not shown), at the second circulation loop.

Amounts of the first and the second quantities of cooking liquor removed from certain process points and added back to other process points should be adjusted to achieve the most preferred EA concentration profile in all cooking stages that follow the impregnation stage. Consideration should also be given to the liquor removal and addition locations with regard to hydraulic balance of the digester, as well as to the ease of chip column movement for improved digester operational stability.

By practicing the present invention, the EA concentration profile in PS pulping with modified cooking in a continuous digester is more even than that in a conventional Kraft cook, retaining all essential benefits from modified cooking. At the same time, since all PS is put to use at the beginning of the cook, maximum pulp yield increase from PS pulping is realized.

Example 5

Figure 6:
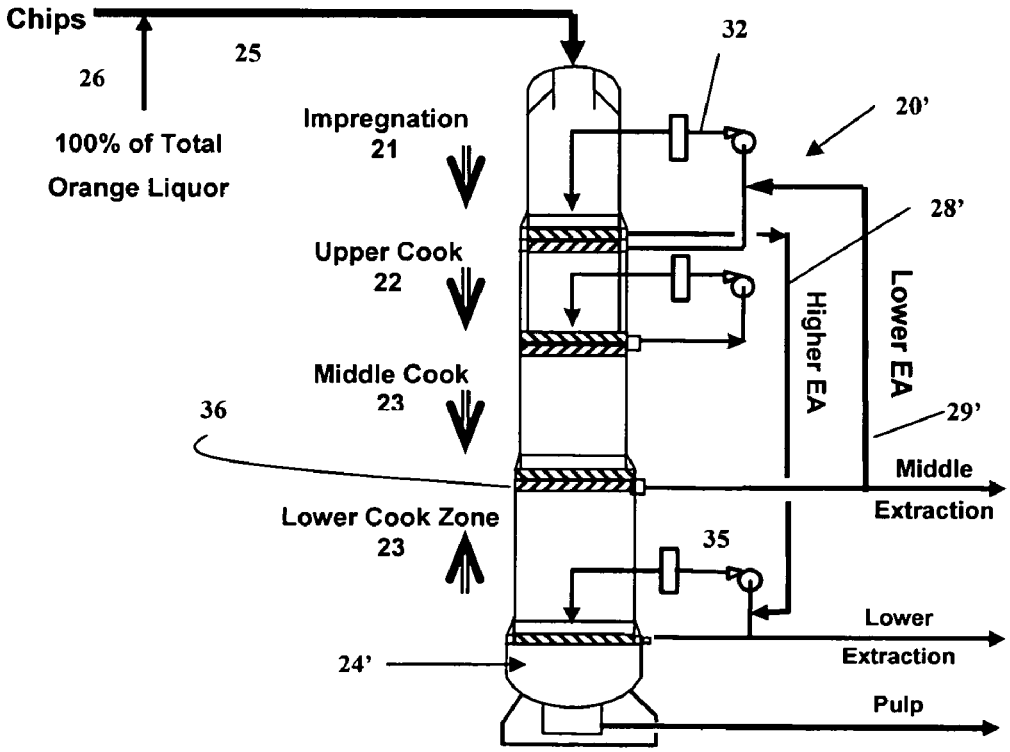
FIG. 6 shows another embodiment of the present invention in a continuous digester wherein the last cooking stage runs in a counter-current mode.

FIG. 6 illustrates another embodiment of the present invention in a continuous digester 20' running the last cooking stage 24' in a counter-current mode. The third, and last, circulation loop 27' in this embodiment exits the digester at the end of the third cook stage 24' and then re-enters an earlier point in the third cook stage. The first quantity 31' of cooking liquor relatively high in EA concentration is removed from the first set of screens 30 at the end of the impregnation stage 21 and added to the last circulation loop 27'. The second quantity 32' of cooking liquor, relatively low in EA concentration, is removed from the middle extraction 35 (taken from the digester at the second last set of screens 34) and added to the first circulation loop 25, whose inlet is located downstream of the removal point for the first quantity of liquor.

As discussed before, amounts of the first and the second quantities of cooking liquor removed from certain process points and added back to other process points should be adjusted to achieve the most preferred EA concentration profile in all cooking stages that follow the impregnation stage. Consideration should also be given to the liquor removal and addition locations with regard to hydraulic balance of the digester, as well as to the ease of chip column movement for improved digester operational stability.

Example 6

Figure 7A:
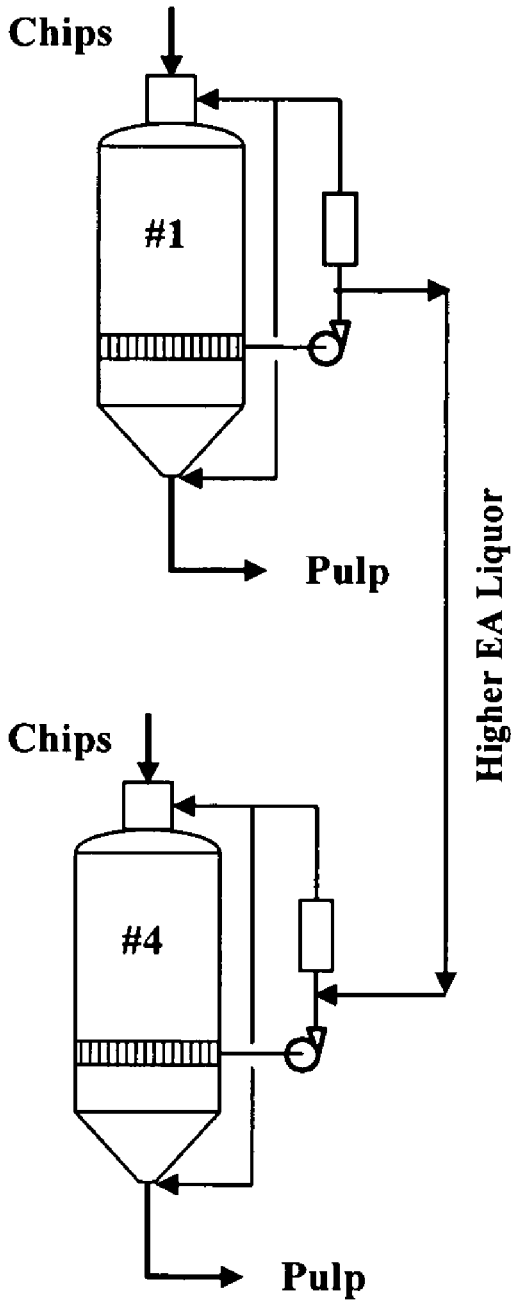
FIGS. 7*a* & 7*b* show an exemplary installation of the present invention in a battery of batch digesters.
Figure 7B:
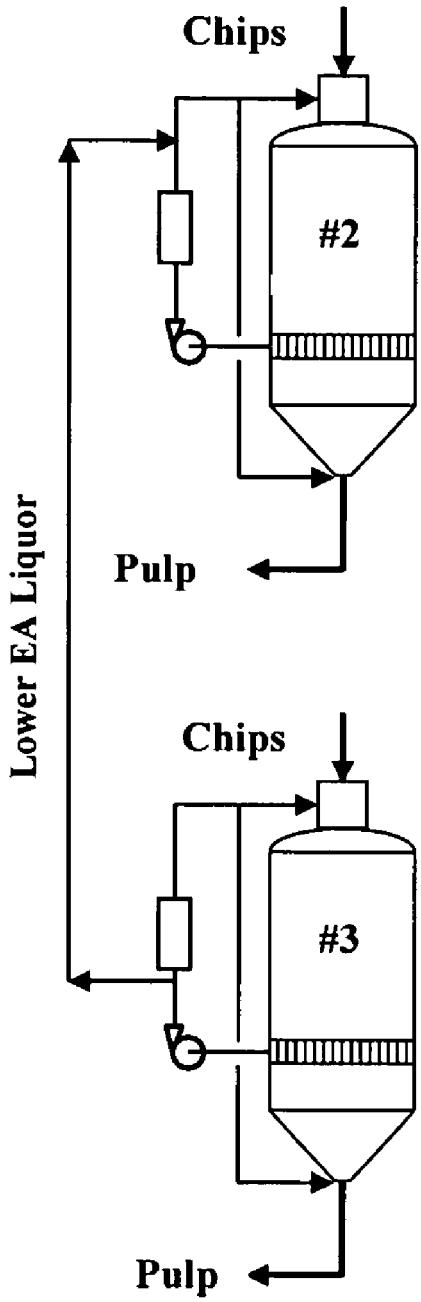

FIGS. 7*a* & 7*b* illustrate the application of the present invention in a battery of batch digesters 410, 420, 430 and 440 capable of running modified batch cooking. For each digester the 100% required alkali dosage in the form of polysulfide (orange) liquor is added to the beginning of a cook, either together with wood chips or after all required wood chips have been added. Each batch digester, e.g., digester #1, is equipped with a cooking circulation loop 411, consisting of a set of drainer (extraction screen) 412, a circulation pump 413 and a heater 414. The first quantity of cooking liquor 44 high in effective alkali is removed from digester vessel #1 that is just at the end of the impregnation stage, and added to another digester (vessel #4), which completed the impregnation stage and has undergone substantial cooking, e.g., at least 30 minutes at cooking temperature and after the second quantity of cooking liquor low in effective alkali was removed from this vessel. The second quantity of cooking liquor 46 low in effective alkali concentration, removed from digester #3 is added to digester vessel #2 after the first quantity of cooking was removed.

Alternatively, the first quantity and second quantity of removed liquor may be stored in separate liquor tanks before being pumped into another digester at a different cooking stage to achieve the preferred alkali concentration profile.

As can be seen, according to the invention a cooking liquor of relatively high effective alkali concentration is "exchanged" with a cooking liquor of relatively low effective alkali concentration, wherein the cooking liquors of relatively high and low concentrations, respectively, are extracted from the cooking process at different process points or times and reinserted or recycled into the cooking process at other points or times.

While particular embodiments of the invention have been illustrated and described in detail herein, it should be understood that various changes and modifications may be made in the invention without departing from the spirit and intent of the invention as defined by the appended claims.

What is claimed is:

1. A method for Kraft pulping employing a modified cooking process in conjunction with polysulfide pulping technologies in a cooking vessel to obtain higher pulping yields than previously obtained, wherein:

a first quantity of cooking liquor is extracted from the cooking process at a first point in the modified cooking process and exchanged with a second quantity of cooking liquor with an effective alkali concentration lower than the first quantity of liquor extracted from the modified cooking process at another point, wherein:

the total required cooking alkali charge, in the form of polysulfide liquor, is added to the beginning of the cook, and after essentially all polysulfide has reacted with lignocellulosic material at temperature around or below 135° C., at or below which no significant carbohydrate degradation occurs, said first quantity of the cooking liquor is removed from said first point in the cooking process and replaced with said second quantity of cooking liquor, the second quantity of cooking liquor being one of equal to, greater than, or smaller than the first quantity, and the removed first quantity of cooking liquor is then added elsewhere in the pulping process, where the effective alkali concentration is low, whereby the full yield benefit from polysulfide pulping is realized while at the same time a more even effective alkali concentration profile is achieved to retain benefits of modified cooking.

2. The method according to claim 1, wherein:

the beginning, or first stage, of the cook comprises an impregnation stage, and the impregnation stage conditions are controlled to around or below 135° C. for 15-45 minutes, to react essentially all polysulfide with lignocelluloses material so that no substantial carbohydrates degradation and polysulfide thermal decomposition occur, and adjusting the amounts of the first quantity and the second quantity of liquors removed from the respective process points and the amounts to be added back to the cook at other process points, as well as their relative removal and addition process points, to control the maximal concentration of effective alkali throughout all cooking stages that follow the impregnation stage.

3. The method according to claim 2, wherein:

the maximal concentration of effective alkali is kept at or below 18 g/L as NaOH (0.45M NaOH or 14 g/L as $Na_2O$) throughout all cooking stages that follow the impregnation stage.

4. The method according to claim 2, wherein:

the maximal alkali concentration is kept at or below 12 g/L as NaOH (0.3M NaOH, or 9.3 g/l, as $Na_2O$) in all cooking stages that follow the impregnation stage.

5. The method according to claim 2, wherein:

the maximal alkali concentration is kept at or below 24 g/L as NaOH (0.6M NaOH, or 18.6 g/L as $Na_2O$) in all cooking stages that follow the impregnation stage.

6. A method for Kraft pulping employing a modified cooking process in conjunction with polysulfide pulping technologies, comprising the steps of:

(a) heating up chips of a wood furnish in a digester vessel;

(b) adding the total alkali charge required for the cook in the form of polysulfide liquor containing an equivalent of about 0.7% polysulfide on wood with a sulfidity of about 14% on an active alkali basis, corresponding to an effective alkali/wood charge of about 20.0% as NaOH (15.5% as $Na_2O$) at the beginning of the cook, and bringing the cooking liquor/wood ratio to about 3.5 by adding an appropriate amount of water to the cook;

(d) heating up the cook from about 60° C. to about 120° C. in about 15 minutes;

(e) maintaining the cook at about 120° C. for about 30 minutes to affect an impregnation stage;

(f) collecting a first quantity of cooking liquor, in an amount equivalent to about 1.2 times the total wood charge by weight, for use in a next cook;

(g) adding to the digester vessel a second quantity of cooking liquor with an effective alkali concentration lower than the first quantity of liquor collected from a previous cook;

(h) heating up the cook to full cooking temperature of about 157° C. in about 30 minutes and maintaining the cook at this temperature for about 45 minutes;

(i) collecting from the digester vessel a further second quantity of cooking liquor in an amount equivalent to about 1.2 times the total wood charge by weight and storing this second quantity of cooking liquor for use in a next cook;

(j) adding to the digester vessel a further first quantity of cooking liquor collected from a previous cook, and maintaining the full cooking temperature during this liquor exchange;

(k) continuing the cook at this full cooking temperature for about another 150 minutes;

(l) cooling the cook down to about 100° C.;

(m) washing the cooked chips with water;

(n) processing the washed cooked chips into fibers by mechanical mixing in a dilute water suspension; and (o) screening the pulp using a screen.

7. The method according to claim 6, including the step of: adding 0.05% anthraquinone at the beginning of the cook.

8. A method for Kraft pulping employing a modified cooking process in conjunction with polysulfide pulping technologies in a vertical single-vessel continuous digester comprising one impregnation stage at the top, and multiple cook stages below the impregnation stage, comprising the steps of:

feeding to the top of the digester pre-heated wood chips;

adding to the top of the digester, at the beginning of a cook, more than 75% of the total required alkali charge, in the form of polysulfide liquor;

moving the chips and cooking liquor downward from the top of the digester and through the impregnation stage to a first set of screens at the end of the impregnation stage and near the top of the digester, within a temperature range of about 110° C. to about 135° C., wherein essentially all polysulfide reacts with woody components, rendering the carbohydrates in the wood chips more stable against alkali-catalyzed degradation and producing a higher pulping yield;

removing a first quantity of cooking liquor via the first set of screens at the end of the impregnation stage;

removing a second quantity of cooking liquor with an effective alkali concentration lower than the first quantity of liquor, from a process point after the impregnation stage;

adding the removed first quantity of cooking liquor back into the digester at a point in the process before the removal point of said second quantity of cooking liquor;

adding the removed second quantity of cooking liquor back into the digester at a point in the process ahead of the removal point of the first quantity of cooking liquor; and controlling amounts of the first and the second quantities of cooking liquor removed from certain process points and added back to other process points to achieve an effective alkali concentration profile in all cooking stages that follow the impregnation stage wherein the effective alkali is at or less than 24 g/L NaOH.

9. The method according to claim 8, wherein:

the multiple cooking stages all run in a co-current mode.

10. The method according to claim 8, wherein:

the multiple cooking stages include at least one cooking stage running in a counter-current mode after the impregnation stage.

11. The method according to claim 8, wherein the multiple cooking stages include:

three cooking stages following the impregnation stage;

a first circulation loop exits the digester at the end of the impregnation stage and re-enters the digester at a point earlier in the impregnation stage;

a second circulation loop exits the digester at the end of the first cook stage and re-enters the digester at a point earlier in the second cook stage;

a third circulation loop exits the digester at the end of the second cook stage and re-enters the digester at a point earlier in the second cook stage;

said removed first quantity of cooking liquor is added to the third circulation loop; and said removed second quantity of cooking liquor is added to the first circulation loop.

* * * * *